US011560816B1

(12) United States Patent
de Oliveira Ghiraldi et al.

(10) Patent No.: US 11,560,816 B1
(45) Date of Patent: Jan. 24, 2023

(54) SPRING RETAINER RETENTION TAB FOR BIAS SPRING

(71) Applicant: Schaeffler Technologies AG & Co. KG, Herzogenaurach (DE)

(72) Inventors: Renato de Oliveira Ghiraldi, Madison Heights, MI (US); Gilson Arima, Rochester Hills, MI (US); Jeffrey Harris, Commerce Township, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 17/736,238

(22) Filed: May 4, 2022

Related U.S. Application Data

(60) Provisional application No. 63/222,635, filed on Jul. 16, 2021.

(51) Int. Cl.
*F01L 1/344* (2006.01)
*F01L 1/46* (2006.01)

(52) U.S. Cl.
CPC ..... *F01L 1/46* (2013.01); *F01L 1/3442* (2013.01); *F01L 2001/34483* (2013.01)

(58) Field of Classification Search
CPC .. F01L 1/3442; F01L 2001/34483; F01L 1/46
USPC ..... 123/90.15
See application file for complete search history.

(56) References Cited

U.S. PATENT DOCUMENTS

| | | | | |
|---|---|---|---|---|
| 6,609,486 | B2 | 8/2003 | Trappe et al. | |
| 7,305,949 | B2 | 12/2007 | McCarthy et al. | |
| 8,671,900 | B2 | 3/2014 | Weber | |
| 9,200,452 | B2 | 12/2015 | Tandler | |
| 10,563,547 | B1 * | 2/2020 | Camilo | F01L 1/3442 |
| 2010/0116233 | A1 | 5/2010 | Weisser et al. | |
| 2011/0073056 | A1 | 3/2011 | Kobayashi et al. | |
| 2013/0180483 | A1 * | 7/2013 | Weisser | F01L 1/3442 123/90.15 |
| 2013/0327288 | A1 * | 12/2013 | Boese | F01L 1/344 123/90.17 |

FOREIGN PATENT DOCUMENTS

| | | | | |
|---|---|---|---|---|
| DE | 102009058449 | A1 | 6/2011 | |
| DE | 102013209053 | A1 * | 11/2014 | B29C 70/347 |
| DE | 102019120082 | A1 * | 1/2021 | |
| WO | 2014056490 | A1 | 4/2014 | |
| WO | 2014183750 | A1 | 11/2014 | |

* cited by examiner

*Primary Examiner* — Jorge L Leon, Jr.

(57) ABSTRACT

A spring retainer for a camshaft phaser is provided that includes an axially extending portion and a disk portion. The disk portion has an axially extending retention tab that is formed integrally therewith. The axially extending portion includes a torsional fixing region configured to torsionally attach a bias spring to the spring retainer. In a first installed position, the retention tab is spaced apart from a straight side of the bias spring. In a second rotationally slipped position, the retention tab is configured to be engaged with the straight side of the bias spring. The spring retainer can be utilized as a timing wheel that is configured to cooperate with a camshaft position sensor to provide an angular position of a camshaft.

18 Claims, 6 Drawing Sheets

SPRING RETAINER RETENTION TAB FOR BIAS SPRING

CROSS-REFERENCE TO RELATED APPLICATIONS

This application claims the benefit under 35 U.S.C. § 119(e) of U.S. Provisional Application No. 63/222,635 filed on Jul. 16, 2021 which application is incorporated herein by reference.

TECHNICAL FIELD

This invention is generally related to a spring retainer for a camshaft phaser.

BACKGROUND

Camshaft phasers are utilized within internal combustion (IC) engines to adjust timing of an engine valve event to modify performance, efficiency, and emissions. Hydraulically actuated camshaft phasers can be configured with a rotor and stator arrangement. The rotor can be attached to the camshaft and actuated hydraulically in clockwise or counterclockwise directions relative to the stator to achieve variable engine valve timing. A spring retainer can be utilized within a camshaft phaser to retain a bias spring, house the bias spring, and serve as a means of attaching the bias spring to the rotor. The spring retainer can also be utilized as a timing wheel to facilitate tracking of a rotational position of the camshaft. Slippage of the bias spring relative to its attachment interface with the spring retainer can be detrimental to the function of the camshaft phaser.

SUMMARY

A spring retainer assembly for a camshaft phaser is provided that includes a bias spring and a spring retainer. The bias spring has a first end with at least two straight spring legs. The spring retainer has a disk portion and an axially extending portion configured to be axially clamped to a rotor of the camshaft phaser. The spring retainer can be used as a timing wheel such that the disk portion includes sensing windows configured to cooperate with a camshaft position sensor to provide an angular position of a camshaft. The disk portion includes an axially extending retention tab formed integrally with the disk portion. The axially extending retention tab is configured to limit rotational slipping of the first end of the bias spring relative to the spring retainer. The axially extending portion has a torsional fixing region defined by at least two straight spring landings, each one of the at least two straight spring landings configured to receive a corresponding one of the at least two straight spring legs in order to torsionally attach the bias spring to the torsional fixing region. In a first installed position of the bias spring, the axially extending retention tab is spaced apart from one of the at least two straight spring legs. In a second slipped position of the bias spring, the axially extending retention tab engages with the one of the at least two straight spring legs.

In an example embodiment, the disk portion of the spring retainer includes a cutout arranged directly adjacent to the axially extending retention tab. In a further aspect, the cutout is crescent-shaped. The cutout can be arranged radially between the axially extending portion and the axially extending retention tab. The axially extending retention tab can be defined by a curved wall extending radially inwardly towards the axially extending portion, and an end of the curved wall is configured to form a spring abutment. In a further aspect, the axially extending retention tab is generally shaped as a partial sphere.

In an example embodiment, the axially extending retention tab and the axially extending portion of the spring retainer each extend in a first axial direction.

In an example embodiment, in the second slipped position of the bias spring, the one of the at least two straight spring legs forms an angle with the corresponding one of the at least two straight spring landings.

In an example embodiment, the torsional fixing region of the spring retainer has three straight spring landings and the bias spring has three straight spring legs. Each one of the three straight spring landings is configured to receive a corresponding one of the three straight spring legs.

A camshaft phaser is provided that includes a rotor, a stator, a bias spring configured to bias the rotor relative to the stator, and a spring retainer. In a first installed position of the bias spring, the bias spring engages the torsional fixing region and does not engage the axially extending retention tab. In a second rotationally slipped position of the bias spring, the bias spring engages the torsional fixing region and the axially extending retention tab.

In an example embodiment, the spring retainer is disposed within the stator and includes an axial retainer formed integrally with the axially extending portion of the spring retainer. The axial retainer is configured to axially retain the spring retainer to the stator.

In an example embodiment, the camshaft phaser includes a bias spring fixing post fixed to the stator. The bias spring fixing post is configured to fix an end of the bias spring to the stator. In a further aspect, the camshaft phaser also includes a bias spring guidepost configured to engage and guide the bias spring in both the first installed position of the bias spring and the second rotationally slipped position of the bias spring.

A camshaft phaser is provided that includes a spring retainer with an axially extending portion that has a plurality of bias spring landings configured to torsionally fix the bias spring to the spring retainer. The bias spring landings define a first straight-sided plane figure configured to complementarily receive a first end of the bias spring defining a second straight-sided plane figure. The axially extending retention tab allows rotation of one straight side of the second straight-sided plane figure relative to a corresponding one straight side of the first straight-sided plane figure until the one straight side of the second straight-sided plane figure abuts with the axially extending retention tab.

BRIEF DESCRIPTION OF THE DRAWINGS

The foregoing Summary will be best understood when read in conjunction with the appended drawings. In the drawings.

DETAILED DESCRIPTION

A term "non-rotatably connected" can be used to help describe various connections of camshaft phaser components and is meant to signify two elements that are directly or indirectly connected in a way that whenever one of the elements rotate, both of the elements rotate in unison, such that relative rotation between these elements is not possible. Radial and/or axial movement of non-rotatably connected elements with respect to each other is possible, but not required.

Figure 1:
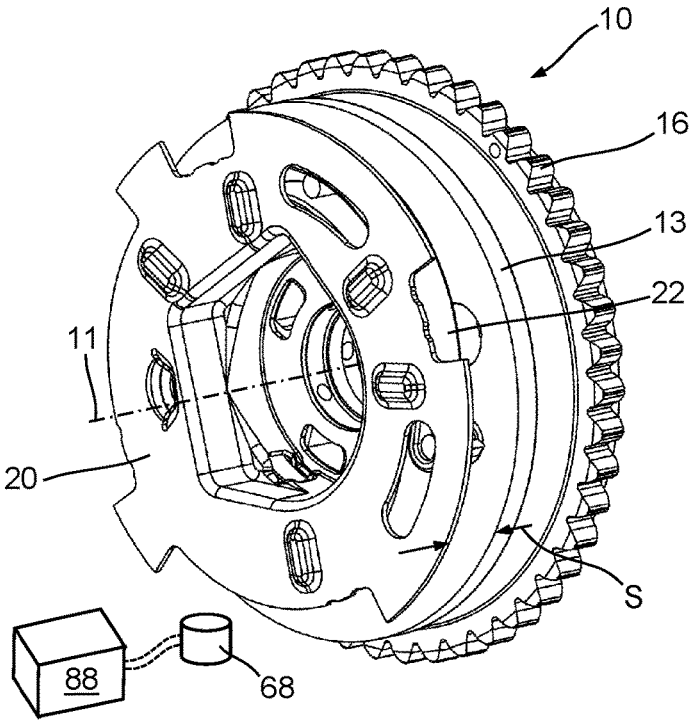
FIG. 1 is a perspective view of a camshaft phaser that includes an example embodiment of a spring retainer utilized as a timing wheel.
Figure 2:
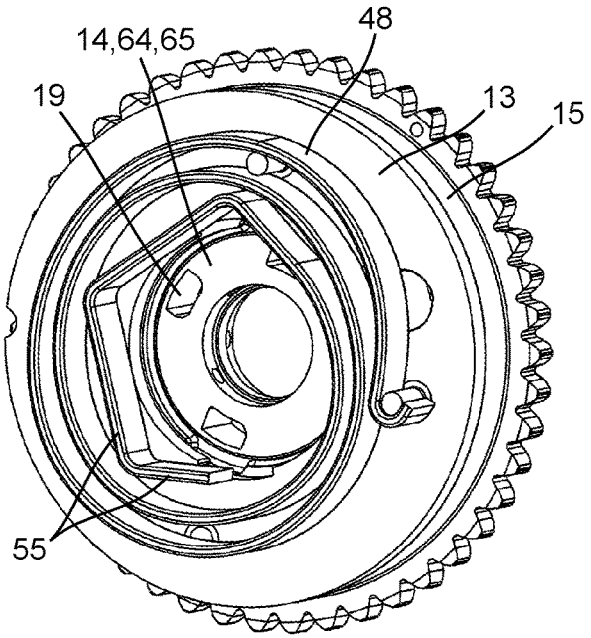
FIG. 2 is a perspective view of the camshaft phaser of FIG. 1 without the spring retainer.
Figure 3:
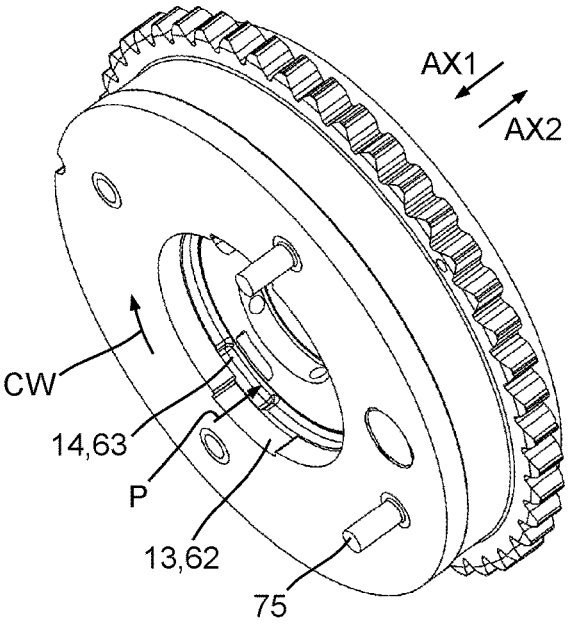
FIG. 3 is a perspective view of the camshaft phaser of FIG. 1 without the spring retainer and bias spring.
Figure 4:
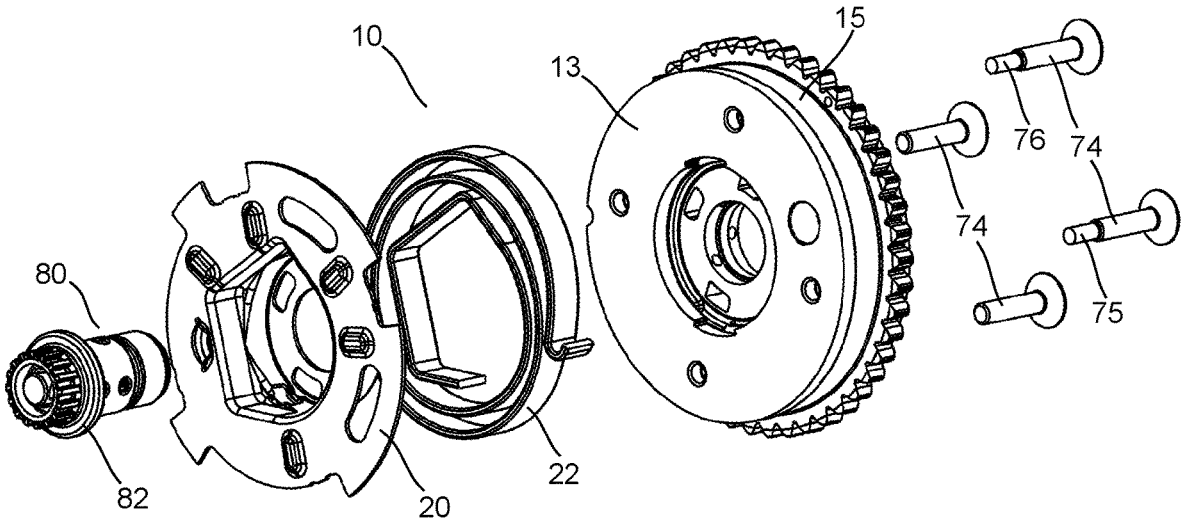
FIG. 4 is an exploded perspective view of the camshaft phaser of FIG. 1 together with an oil control valve.
Figure 5A:
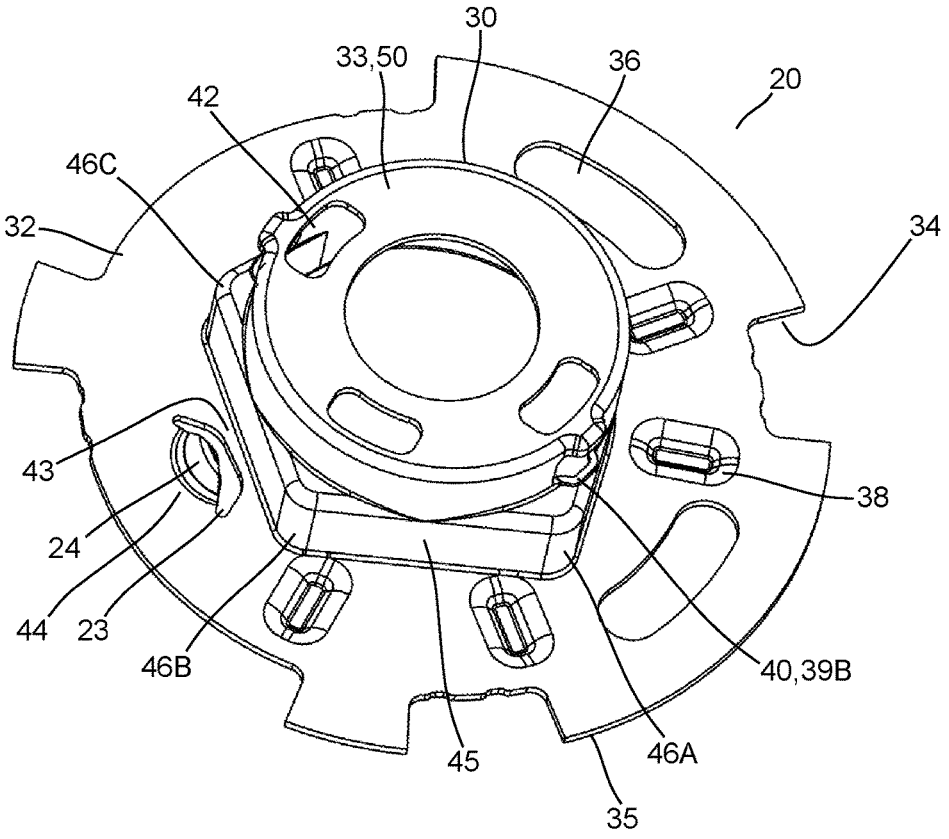
FIG. 5A is a perspective view of the spring retainer of FIG. 1 in a first orientation.
Figure 5B:
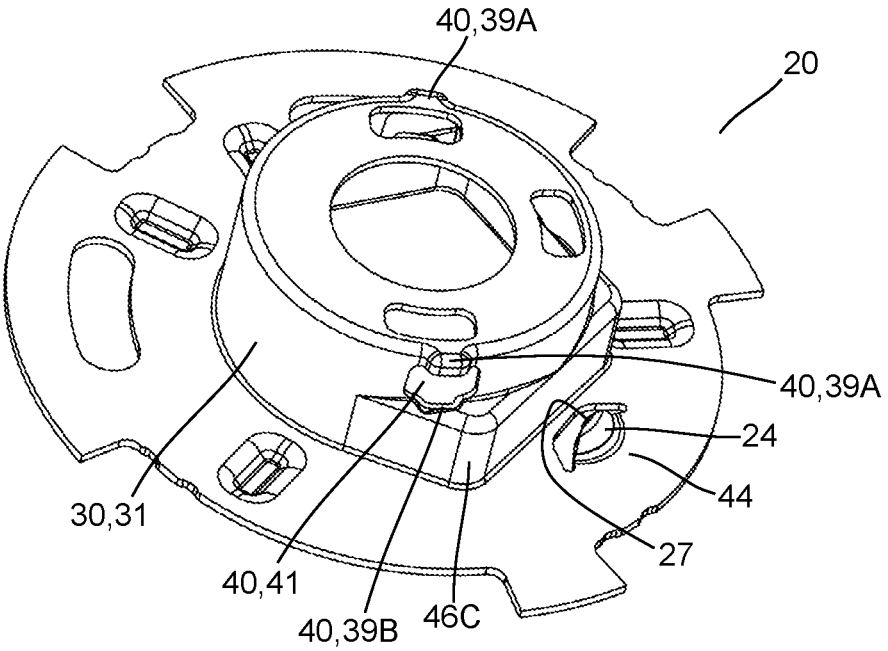
FIG. 5B is a perspective view of the spring retainer of FIG. 1 in a second orientation.
Figure 6:
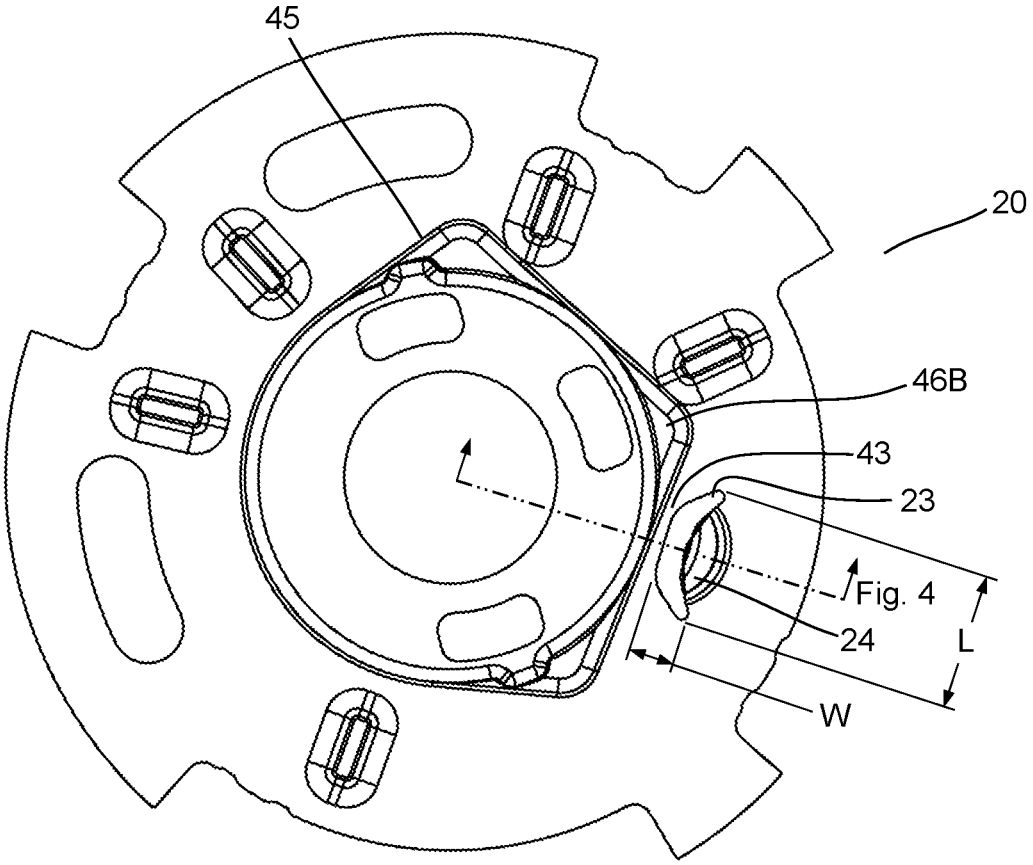
FIG. 6 is a rear view of the spring retainer of FIG. 1.
Figure 7:
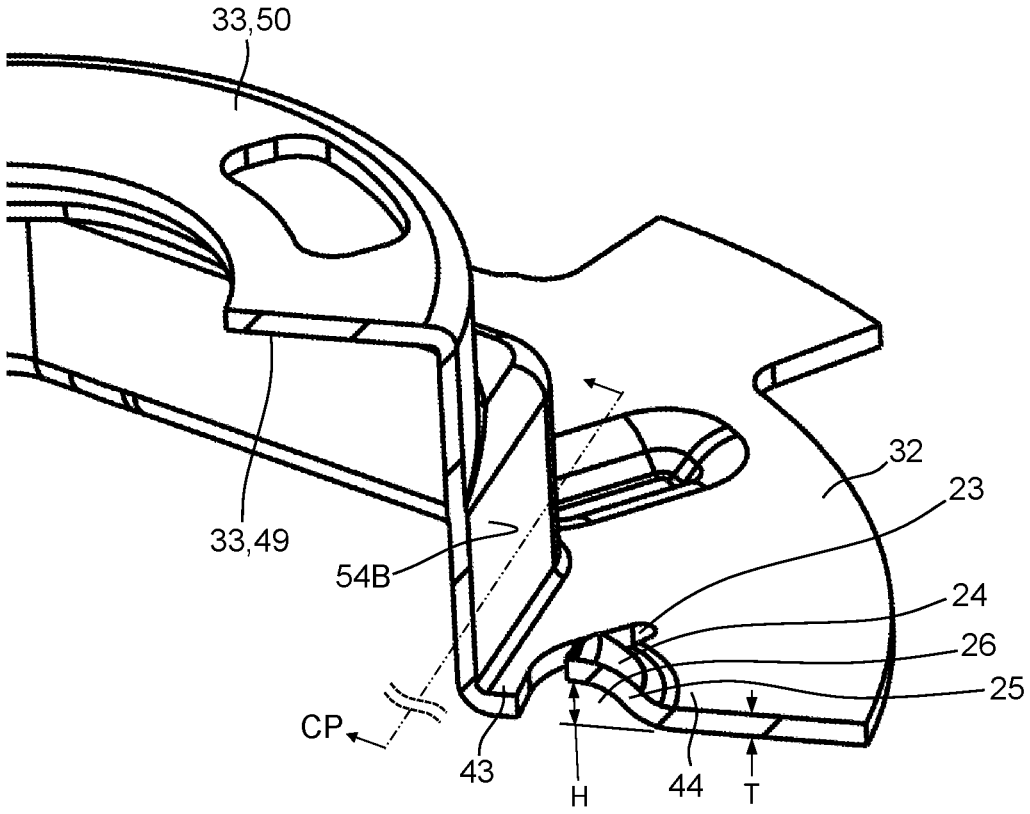
FIG. 7 is a cross-sectional view taken from FIG. 6.
Figure 8:
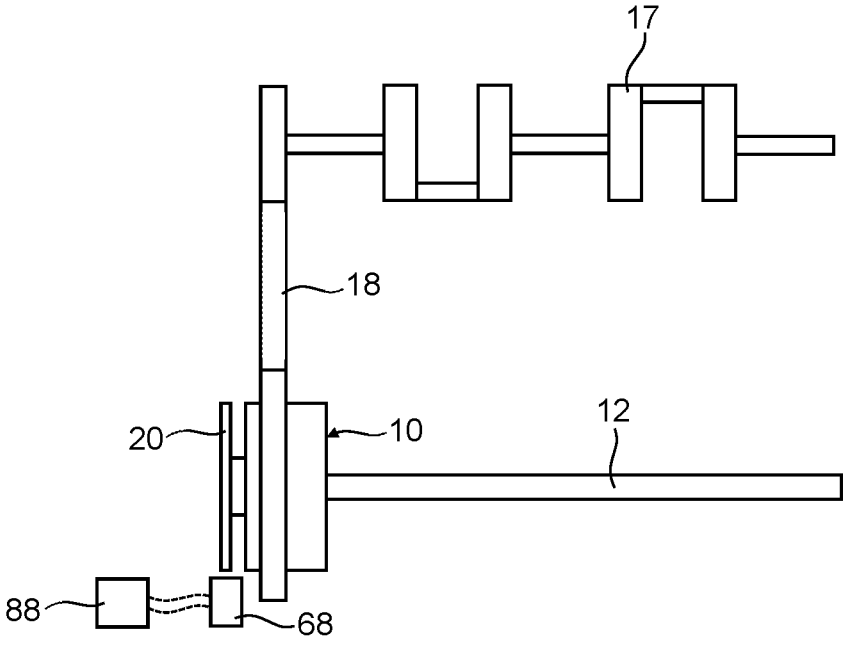
FIG. 8 is a schematic view of the camshaft phaser of FIG. 1 together with a camshaft, with the camshaft phaser non-rotatably connected to a crankshaft via an endless drive band.
Figure 9:
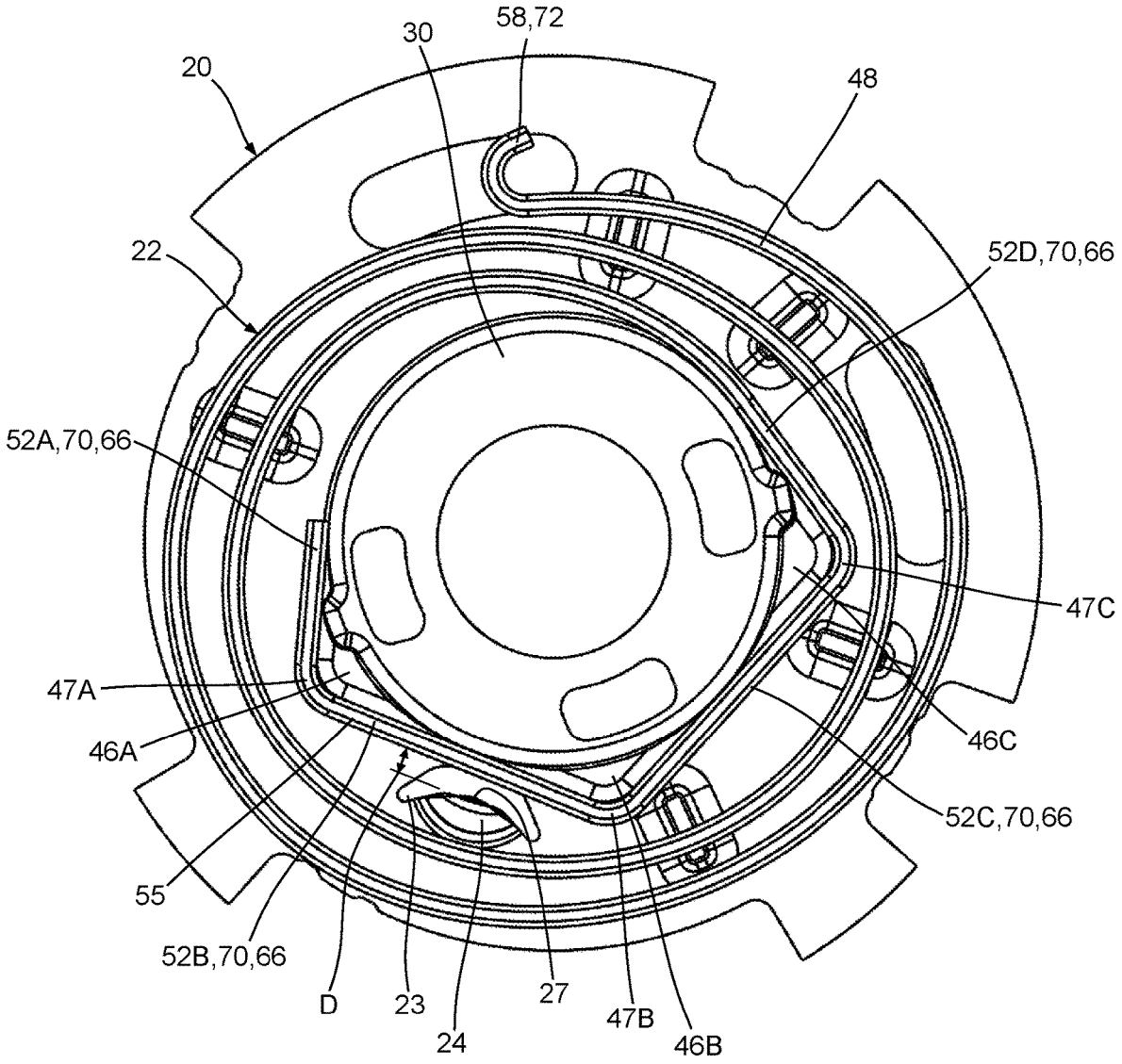
FIG. 9 is a rear view of the spring retainer of FIG. 1 together with the bias spring shown in a first installed position.
Figure 10:
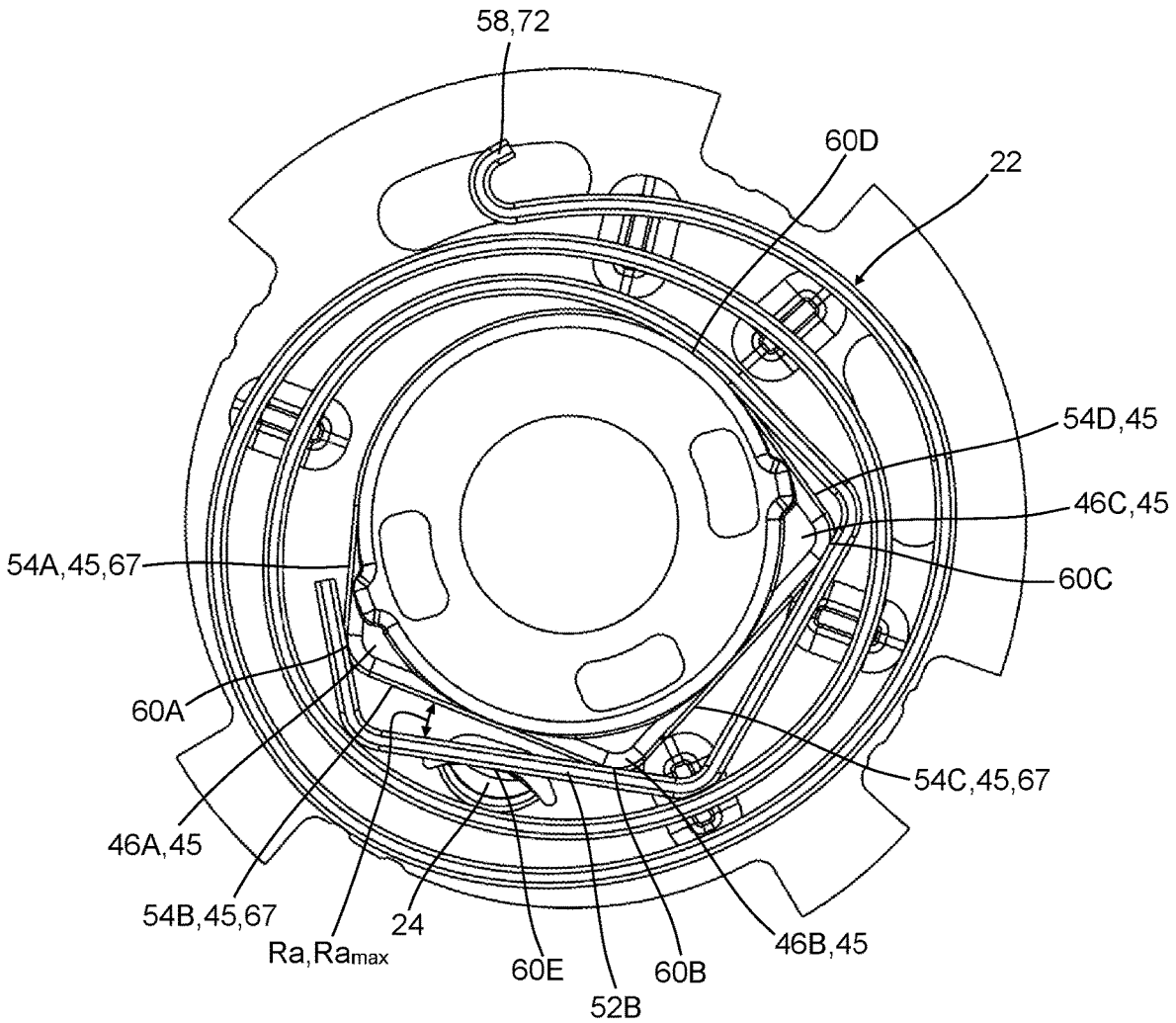
FIG. 10 is a rear view of the spring retainer of FIG. 1 together with the bias spring shown in a second rotationally displaced or slipped position.

FIG. 1 shows a perspective view of a camshaft phaser 10 that includes an example embodiment of a spring retainer 20 utilized as a timing wheel. FIG. 2 is a perspective view of the camshaft phaser 10 of FIG. 1 without the spring retainer 20 installed to expose a bias spring 22. FIG. 3 is a perspective view of the camshaft phaser 10 of FIG. 1 without the spring retainer 20 and bias spring 22. FIG. 4 is an exploded perspective view of the camshaft phaser 10 of FIG. 1 together with an oil control valve (OCV) 80. FIGS. 5A and 5B are perspective views of the spring retainer 20 of FIG. 1 in respective first and second orientations. FIG. 6 is a rear view of the spring retainer 20 of FIG. 1. FIG. 7 is a cross-sectional view taken from FIG. 6. FIG. 8 is a schematic representation of the camshaft phaser 10 of FIG. 1 together with a crankshaft 17 of an IC engine. FIG. 9 is a rear view of the spring retainer 20 of FIG. 1 together with the bias spring 22 in a first installed position. FIG. 10 is a rear view of the spring retainer 20 of FIG. 1 together with the bias spring 22 in a second slipped position. The following discussion should be read in light of FIGS. 1 through 10.

The spring retainer 20 includes a disk portion 32 and an axially extending portion 30. The disk portion 32 is offset from a cover 13 of the camshaft phaser 10 to define an axial space S within which a bias spring 22 is arranged. In an example embodiment, the spring retainer 20 includes sensing windows 34 formed on a radial outer wall 35 of the disk portion 32 such that the spring retainer 20 is utilized as a timing wheel. The sensing windows 34 cooperate with a camshaft position sensor 68 to provide an angular position of the camshaft 12. The camshaft position sensor 68 can electronically communicate the angular position of the camshaft 12 to an electronic controller 88. It is known that hydraulic actuation of a rotor 14 of the camshaft phaser 10 relative to a stator 15 of the camshaft phaser 10 facilitates phasing of the camshaft 12 to vary a valve timing of the IC engine. It is also known that the bias spring 22 can provide a biasing force on the rotor towards either a full retard or full advance position. The spring retainer 20 is non-rotatably attached to the rotor.

The stator 15 of the camshaft phaser 10 is configured with an endless drive band interface 16 to connect the camshaft phaser 10 to any power source, such as the crankshaft 17 of an internal combustion (IC) engine. The endless drive band 18 can be a belt or a chain to facilitate a non-rotatable connection between the camshaft phaser 10 and the crankshaft 17, causing the camshaft phaser 10 to rotate around a rotational axis 11.

The rotor 14 of the camshaft phaser 10 is non-rotatably connected to the camshaft 12 by axial clamping the spring retainer 20 and rotor 14 to the camshaft 12 via the OCV 80. The OCV 80 is configured with external threads (not shown) that engage internal threads (not shown) of the camshaft 12 to facilitate the axial clamping. Other suitable ways or components to attach the rotor 14 to the camshaft 12 are also possible.

The disk portion 32 of the spring retainer 20 includes stiffening bosses 38, assembly aid windows 36 to ensure proper installation of the bias spring 22, and a retention tab 24. The retention tab 24 is configured to retain or abut with the bias spring 22 via a spring abutment 27. The retention tab 24 is formed with a forming tool so that sheet metal is displaced in an axial direction from the disk portion 32 towards the camshaft 12, defining a height H of the retention tab 24. The act of displacing the material creates a void, empty space, or cavity 26 below the retention tab 24. The formation of the retention tab 24 can be accomplished via a piercing and forming process or any other suitable processes. The retention tab 24 can be formed with a curved wall 25 so that it resembles a portion of a dome. The curved wall 25 can extend radially inwardly towards the axially extending portion 30. An end of the curved wall 25, or a radially inner-most extent of the curved wall can form the spring abutment 27. A generally crescent-shaped cutout 23, achieved via a cutting or piercing process, can be arranged adjacently to the retention tab 24. The crescent-shaped cutout 23 separates the retention tab 24 from a radially inner portion 43 of the disk portion 32 while also serving as a means of stress reduction in the area surrounding the retention tab 24. The crescent-shaped cutout 23 has a length L that is greater than its width W. Other suitable shapes of the cutout 23 are also possible.

The retention tab 24 is formed integrally with or adjoins with the disk portion 32 of the spring retainer 20, or, more particularly, is formed integrally with a radially outer portion 44 of the disk portion 32. The crescent-shaped cutout 23 separates the radially inner portion 43 of the disk portion from the retention tab 24. The empty space, void, or cavity 26 formed beneath the retention tab 24 can be adjoined to the crescent-shaped cutout 23. This empty space, void, or cavity 26 can be defined by the previously described height H, as shown in FIG. 7. The height of the cavity 26 is greater than a wall thickness T of the disk portion 32 from which the retention tab 24 is formed therefrom.

The manufacturing steps of achieving the retention tab 24 are as follows:

STEP 1: piercing or shearing of the sheet metal disk portion 32 of the spring retainer 20 to obtain the cutout 23.

STEP 2: applying a forming tool to a portion arranged radially outwardly of the cutout 23 to axially displace and form sheet metal material to achieve the retention tab 24.

The axially extending portion 30 of the spring retainer 20 includes tool openings 42 that are arranged on a radial flange 33, axial retainers 40 arranged in a radial wall 31, and a torsional fixing region 45 for the bias spring 22. A description of each of these features now follows.

The tool openings 42 provide access for a tool that can access tool receiving apertures 19 arranged circumferentially around a hub 65 of the rotor 14 to rotationally hold the spring retainer 20 and rotor 14 during attachment of the OCV 80 to the camshaft 12. The tool receiving apertures 19 can extend partially or axially through the hub 65. The act of threading the OCV 80 to the camshaft 12 causes a flange 82 of the OCV 80 to axially clamp the radial flange 33 of the spring retainer 20 and hub 65 of the rotor 14 to the camshaft 12. During this threading process, the flange 82 of the OCV 80 engages an inner axial face 49 of the radial flange 33 so that an outer axial face 50 of the radial flange 33 engages a front axial face 64 of the rotor 14.

The axial retainers 40 include first and second fingers 39A, 39B and an aperture 41 that axially separates the two fingers. The axial retainers 40 axially retain the spring retainer 20 to the stator 15 via the cover 13. This axial retention is utilized during the camshaft phaser assembly process and transport of the camshaft phaser 10 before the OCV 80 attaches the camshaft phaser 10 to the camshaft 12. FIG. 3 shows a cover groove 62 and a rotor groove 63 that facilitate this axial retention. An overlapping of these two grooves provides for an insertion pathway P for one of the axial retainers 40. Once inserted to an appropriate depth, the spring retainer 20 is rotated clockwise CW such that the first and second fingers 39A are rotated out of the overlapping of the two grooves such that the first and second fingers 39A, 39B envelope the cover 13. This rotated and axially retained position of the spring retainer 20 is shown FIG. 1. In this retained position: i) the first finger 39A is arranged between the cover 13 and the front axial face 64 of the rotor 14 in an axial direction so that axial retention is provided in a first axial direction AX1, and ii) the second finger 39B is arranged outside of the cover 13 so that axial retention is provided in a second axial direction AX2. The axial retainers 40 permit rotation of the rotor 14 relative to the stator 15 during operation of the camshaft phaser 10.

The torsional fixing region 45 includes first, second, and third retention elbows 46A-46C that are adjoined with first, second, third, and fourth straight spring landings 54A-54D. The bias spring 22 is installed on the torsional fixing region 45 of the axially extending portion 30 of the spring retainer 20. A first end 70 of the bias spring forms a first straight-sided plane FIG. 66 that includes four straight spring legs 52A-52D that are adjoined to each other via three spring elbows 47A-47C. The four spring legs 52A-52D and the four spring elbows 47A-47C are complementarily received by a second straight-sided plane FIG. 67 that includes four straight spring landings 54A-54D and three retention elbows 46A-46C, which define the torsional fixing region 45. The term "straight-sided plane figure" is meant to describe a two-dimensional shape that is composed of straight lines, however, curved lines can also be present, such as the case for the instances of the first and second straight-sided plane FIGS. 66, 67 of this disclosure. The two-dimensional shape is achieved when a cutting plane CP (see FIG. 7) orthogonal to the rotational axis 11 is applied to the torsional fixing region 45. A first leg 52A of the bias spring 22 can directly engage the first spring landing 54A, a second leg 52B of the bias spring 22 can directly engage the second spring landing 54B, a third leg 52C of the bias spring 22 can directly engage the third spring landing 54C, and a fourth leg 52D of the bias spring 22 can directly engage the fourth spring landing 54D. Likewise, the first, second, and third elbows 47A-47C of the bias spring 22 can directly engage respective first, second, and third retention elbows 46A-46C. The previously described fitments are shown in FIG. 9, which defines a first installed position of the bias spring 22 on the axially extending portion 30 of the spring retainer 20.

FIG. 10 shows the bias spring 22 in a second rotationally displaced or slipped position relative to the axially extending portion 30 of the spring retainer 20. The position of the rotor 14 relative to the stator 15 that corresponds with the bias spring positions of FIGS. 9 and 10 is the same, therefore, the bias spring positions of FIGS. 9 and 10 do not depict different valve timings. It is evident from the Figures that the second rotationally displaced position of the bias spring 22 relative to the spring retainer 20 will yield a lower torsional force on the rotor 14 due to the unwinding of the bias spring 22. The second rotationally displaced position of the bias spring 22 is defined by first, second, third, and fourth contact zones 60A-60D between the bias spring 22 and the axially extending portion 30 which may be different and smaller than the contact zones in the first installed position of the bias spring 22. The bias spring 22 can be retained axially in respective first and second axial directions AX1, AX2, by the disk portion 32 of the spring retainer 20 and the cover 13.

FIG. 10 also shows a fifth contact zone 60E between the second leg 52B of the bias spring 22 and the spring abutment 27 of retention tab 24. This fifth contact zone 60E prevents further rotation or slippage of the bias spring 22 relative to the spring retainer 20. The location of the retention tab 24 could be moved to a different location than that which is shown in the Figures. For example, the retention tab 24 could be moved closer to the second spring landing 54B or at a different longitudinal position relative to the second spring landing 54B. In the example embodiment shown in the Figures, the retention tab 24 retains an inner-most coil 55 of the bias spring 22, with the inner-most coil 55 including the first, second, third, and fourth legs 52A-52D and the first, second, and third spring elbows 47A-47C. The retention tab 24 could also be arranged to retain other coils than just the inner-most coil, and, furthermore, more than one retention tab 24 could be applied to retain any single coil or multiple coils.

In the example embodiment shown in the Figures, the bias spring 22 is in contact with the retention tab 24 in the second displaced position, but not in contact with the retention tab 24 in the first installed position. Therefore, the retention tab 24 could be described as a "spring catch" given that it catches the spring in case of rotational slippage of the bias spring 22. However, in a further example embodiment, the retention tab 24 is in constant contact with the bias spring 22 during all operating conditions or rotated positions of the bias spring 22, including a position where the bias spring 22 is not rotated relative to the spring retainer 20 (such as that shown in FIG. 9).

The placement of the retention tab 24 allows rotational slippage of the bias spring 22 relative to the torsional fixing region 45 until abutment with the retention tab 24 occurs. As shown in FIG. 9, the retention tab 24 is spaced apart from the second leg 52B of the bias spring 22 a distance D. Referring to FIG. 10, rotation of the second leg 52B of the bias spring 22 occurs relative to its corresponding second spring landing 54B. This rotation can be defined by a rotational angle Ra and can range from zero degrees to a maximum angle $Ra_{max}$ defined by the retention tab 24, particularly where the second leg 52B contacts the spring abutment 27 as defined by the fifth contact zone 60E. The zero degree rotational angle Ra is present when the second leg 52B of the bias spring 22 is fully engaged with the second spring landing 54B which occurs in the first installed position shown in FIG. 9. For any slippage or rotations of the second leg 52B that are less than $Ra_{max}$, no contact occurs between the second leg 52B and the spring abutment 27 of the retention tab 24.

The camshaft phaser is assembled via fasteners 74 that secure the cover 13 (and an additional cover not shown) to the stator 15. A second end 72 of the bias spring 22 includes a hook 58 or loop that engages a bias spring fixing post 75 that protrudes from an end of one of the fasteners 74. Therefore, the bias spring fixing post 75 facilitates fixing of the second end 72 of the bias spring 22 to the stator 15.

A second one of the fasteners 74 includes a bias spring guidepost 76 that protrudes from an end (similar to the bias spring fixing post 75) and serves as a guide for an outer-most spring coil 48 to ensure proper placement for optimum functionality and durability of the bias spring 22. The bias spring guidepost 76 is in constant engagement with the outer-most spring coil 48. Additional spring guideposts can also be utilized other than the one that is shown in the Figures.

The retention tab 24 can be formed as a portion of a dome or have a rounded outer contour as shown in the Figures or any other suitable shape that retains the bias spring 22. The dome can define the previously described empty space, voice, or cavity 26; therefore, it could be stated that this empty space 26 also takes the shape of a portion of a dome.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A spring retainer assembly for a camshaft phaser, the spring retainer assembly comprising:

a bias spring including a first end with at least two straight spring legs; and a spring retainer comprising:

a disk portion including an axially extending retention tab formed integrally with the disk portion, the retention tab configured to limit rotational slipping of the first end of the bias spring relative to the spring retainer; and an axially extending portion including a torsional fixing region defined by at least two straight spring landings respectively configured to receive the at least two straight spring legs so as to torsionally attach the bias spring to the torsional fixing region; and a cutout arranged radially between the axially extending portion and the retention tab, wherein:

in a first installed position of the bias spring, the retention tab is spaced apart from a first spring leg of the at least two straight spring legs; and in a second slipped position of the bias spring, the retention tab is engaged with the first spring leg.

2. The spring retainer assembly of claim 1, wherein the cutout is crescent-shaped.

3. The spring retainer assembly of claim 1, wherein the retention tab is defined by a curved wall extending radially inwardly towards the axially extending portion, and an end of the curved wall is configured to form a spring abutment.

4. The spring retainer assembly of claim 1, wherein the retention tab and the axially extending portion each extend in a first axial direction.

5. The spring retainer assembly of claim 1, wherein the retention tab is shaped as a partial sphere.

6. The spring retainer assembly of claim 1, wherein a wall of the retention tab is curved.

7. The spring retainer assembly of claim 1, wherein in the second slipped position, the first spring leg forms an angle with a corresponding spring landing of the at least two straight spring landings.

8. The spring retainer assembly of claim 1, wherein the at least two straight spring landing include three straight spring landings, and the at least two straight spring legs include three straight spring legs.

9. The spring retainer of claim 1, wherein the disk portion further includes sensing windows configured to cooperate with a camshaft position sensor so as to provide an angular position of a camshaft.

10. A camshaft phaser comprising:

a rotor configured to be non-rotatably fixed to a camshaft;

a stator;

a bias spring configured to bias the rotor relative to the stator; and a spring retainer comprising:

an axially extending portion defining a torsional fixing region configured to non-rotatably fix the bias spring to the spring retainer; and a disk portion including an axially extending curved retention tab formed integrally with the disk portion, the retention tab configured to limit rotational slipping of the bias spring relative to the torsional fixing region, wherein:

in a first installed position of the bias spring, the bias spring engages the torsional fixing region and is disengaged from the retention tab; and in a second rotationally slipped position of the bias spring, the bias spring engages the torsional fixing region and the retention tab.

11. The camshaft phaser of claim 10, wherein the disk portion further includes a cutout directly adjacent to the retention tab.

12. The camshaft phaser of claim 10, wherein the spring retainer is disposed within the stator.

13. The camshaft phaser of claim 12, wherein the spring retainer further comprises an axial retainer formed integrally with the axially extending portion, the axial retainer configured to axially retain the spring retainer to the stator.

14. The camshaft phaser of claim 10, further comprising a bias spring fixing post fixed to the stator, the bias spring fixing post configured to fix an end of the bias spring to the stator.

15. The camshaft phaser of claim 14, further comprising a bias spring guidepost configured to engage and guide the bias spring when in the first installed position and when in the second rotationally slipped position.

16. A camshaft phaser comprising:

a stator;

a rotor configured to be non-rotatably fixed to a camshaft;

a bias spring configured to bias the rotor relative to the stator; and a spring retainer comprising:

an axially extending portion including a plurality of bias spring landings configured to torsionally fix the bias spring to the spring retainer, the bias spring landings defining a first straight-sided plane figure configured to complementarily receive a first end of the bias spring defining a second straight-sided plane figure;

a disk portion including an axially extending retention tab formed integrally with the disk portion, the retention tab configured to allow rotation of a first straight side of the second straight-sided plane figure relative to a corresponding first straight side of the first straight-sided plane figure until the first straight side of the second straight-sided plane figure abuts with the retention tab; and a cutout arranged radially between the axially extending portion and the retention tab.

17. The camshaft phaser of claim 16, wherein the cutout adjoins a cavity formed by the retention tab.

18. The camshaft phaser of claim 16, wherein the spring retainer is configured to cooperate with a camshaft position sensor so as to provide an angular position of a camshaft.

* * * * *